United States Patent [19]

Amann

[11] 4,051,821

[45] Oct. 4, 1977

[54] EXHAUST BACK PRESSURE CONTROL

[75] Inventor: Charles A. Amann, Bloomfield Hills, Mich.

[73] Assignee: General Motors Corporation, Detroit, Mich.

[21] Appl. No.: 718,812

[22] Filed: Aug. 30, 1976

[51] Int. Cl.[2] ..... F02D 31/00; F01N 7/00

[52] U.S. Cl. ..... 123/97 B; 60/324

[58] Field of Search ..... 123/97 B, 107, 113; 60/292, 342

[56] References Cited

U.S. PATENT DOCUMENTS

| | | | |
|---|---|---|---|
| 2,730,090 | 1/1956 | Holl | 123/97 B |
| 2,744,510 | 5/1956 | Tyler et al. | 123/97 B |
| 3,577,727 | 5/1971 | Warren | 60/292 |
| 3,838,670 | 10/1974 | King | 123/97 B |

FOREIGN PATENT DOCUMENTS

| | | | |
|---|---|---|---|
| 1,179,765 | 10/1964 | Germany | 123/97 B |

*Primary Examiner*—Ronald H. Lazarus
*Assistant Examiner*—Craig R. Feinberg
*Attorney, Agent, or Firm*—K. H. MacLean, Jr.

[57] ABSTRACT

An exhaust pressure maintenance system and apparatus for an engine exhaust system which imposes a scheduled back pressure on the engine independently of restrictions in the exhaust lines downstream from a pressure controller valve. The back pressure which is maintained is purposely lower at low flow rates than at high flow rates, so that the engine power is not unnecessarily diminished under these conditions.

3 Claims, 1 Drawing Figure

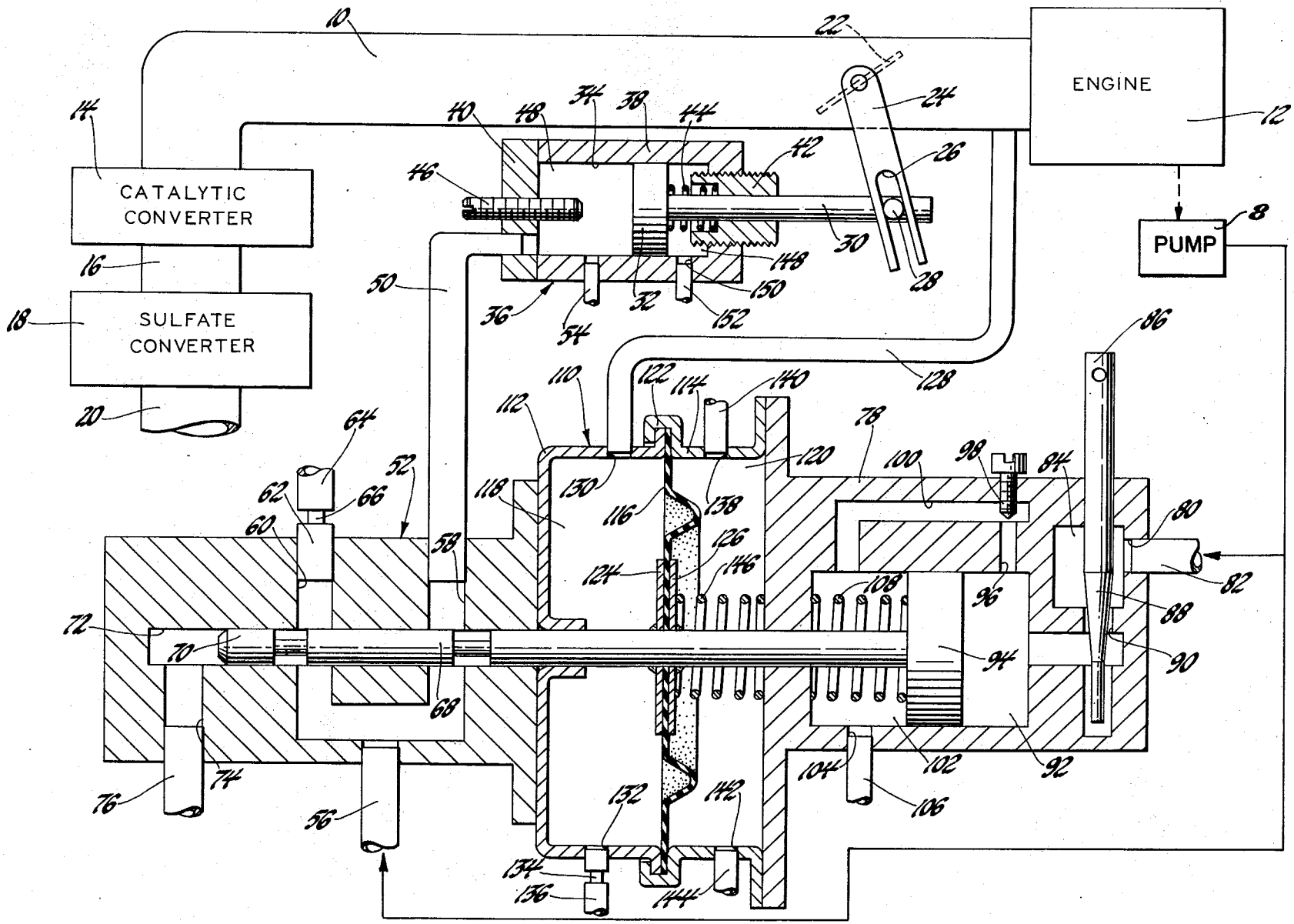
ENGINE
PUMP
CATALYTIC CONVERTER
SULFATE CONVERTER

EXHAUST BACK PRESSURE CONTROL

Exhaust system components, such as sulfate traps, may be employed in exhaust systems associated with internal combustion engines. Thereby, undesirable and changing flow resistances may be created. These flow resistances normally increase as the engine is operated. Increases in resistance naturally increase the exhaust back pressure on the engine. The increase in back pressure affects correct carburetor setting and also decreases manifold vacuum at any given driving condition. This upsets vehicle operation in a number of ways: it reduces maximum power available; it may upset emission control components and their calibration; it disturbs the vehicle's speed and manifold vacuum correction apparatus and thereby may affect the spark timing; it may change the shift points in an automatic transmission; it may upset carburetor metering of fuel; it may reduce the manifold vacuum available for such vacuum-operated components as power brakes. Therefore, it would be desirable to provide means to maintain a relatively constant back pressure on an internal combustion engine when operated in the normal load range, thereby permitting various engine components and calibrations to be set for maximum economy and power.

Although means for controlling back pressure could be devised to impose a constant back pressure on the engine at all times, this penalizes the engine during light load and low speed operation and during periods of idling. During these periods of operation, the engine power efficiency is of particular importance and, therefore, the subject back pressure control is adapted to maintain a scheduled back pressure on the engine that senses other flow restrictions in the exhaust system and compensates for their variances. It also provides lower back pressure at low engine speeds and under light load conditions than at high engine speeds and heavy load conditions.

Therefore, an object of the present invention is to provide an exhaust back pressure maintenance system and apparatus which maintains a scheduled exhaust back pressure on an engine operating in a normal power and load range despite downstream changes in flow restrictions in the exhaust system.

A still further object of the present invention is to provide an exhaust back pressure maintenance system and apparatus which maintains a scheduled back pressure on an engine when operated in a normal power and load range despite downstream changes in flow restrictions in the exhaust system, but which automatically decreases the scheduled back pressure during low speed and light load operation.

Further objects and advantages of the present invention will be more readily apparent from the following detailed description, reference being had to the sole FIGURE in the drawing which illustrates a back pressure control system and apparatus for achieving the aforementioned objects and operational characteristics.

IN THE DRAWING, an exhaust pipe 10 is shown leading from the exhaust system of an engine 12 which is of the internal combustion type commonly associated with motor vehicles. The exhaust pipe 10 is connected to engine 12 (shown schematically) at an input end and connects to the input of a catalytic converter 14. The output of the catalytic converter is connected by piping or conduit 16 to the input of a sulfate converter 18, whose outlet is connected by tubing 20 to a muffler (not shown) which then discharges the treated exhaust to atmosphere. All of these components are generally known and may exhibit changes in flow characteristics over a period of operation.

Downstream from the engine and upstream from the converters is a pivotal exhaust valve 22 within the conduit 10 which is shown in a relatively closed operational position but which may be pivoted clockwise further to a more open position. The exhaust control valve 22 is operably connected to a pivot arm 24 which has a slotted opening 26 therein which engages a pin 28 on a shaft 30. Shaft 30 is connected at the other end to a piston 32 reciprocally mounted within a cylinder bore 34 of a throttle actuator 36. The throttle actuator 36 includes the housing 38 and end member 40 and an adjustable packing or sealing member 42. A spring 44 between the piston 32 and the member 42 normally tends to move the piston 32 to the left in the figure against an adjustable stop member 46.

The variable volume fluid chamber 48 formed in housing 38 is connected by a conduit 50 to a servo valve 52, which pressurizes the chamber 48 with hydraulic fluid for positioning the piston 32 and the interconnected throttling valve 22. A small drain conduit 54 discharges the hydraulic fluid from chamber 48 back to an oil sump of an engine-driven positive displacement oil pump 8. The oil pump 8 is connected by conduit 56 to the servo valve 52 and a first outlet port 58 is connected to chamber 48 by conduit 50. A second outlet 60 is connected by conduits 62, 64 to the sump (not shown) of oil pump 8. A smaller diameter orifice or flow restricter 66 between conduits 62, 64 restricts the flow back to the sump.

The proportioning of oil flow from inlet 56 to the outlets 58 or 60 is accomplished by a slidable control valve 68 in the form of a rod having larger diameter end portions and recessed or reduced diameter portions thereby providing a flow passage. The end 70 of the rod or control valve 68 is reciprocally supported in bore 72 and a drain opening 74 in housing 52 and a conduit 76 permit the return of oil to the sump which may leak past end 70. When the control valve 68 is moved to the left in the figure, more of the oil flows from input 56 through conduit 50 to chamber 48, which in turn causes piston 32 to be moved to the right. This moves the throttling valve 22 toward a more closed position. When the control valve 68 is moved to the right, less flow of the oil from input 56 is directed to the chamber 48 and more flows through conduit 62, 64 to the sump. This partially depressurizes the chamber 48 and permits piston 32 to move to the left and causes the throttling valve 22 to move clockwise to a more open position.

Movement of the control valve 68 is actuated by a pressure-sensing controller assembly which is to the right of valve 52 in the drawing. The controller includes a housing 78 with an oil input opening 80 located at one end in fluid communication with the oil pump by conduit 82. The opening 80 connects the pump with a chamber 84 through which a movable valve stem 86 extends. The valve stem 86 is connected at one end to the throttle mechanism of the vehicle so as to cause the valve stem to move through the chamber 84 as the throttle is opened and closed. The other end of the valve 86 has a tapered portion 88 which is encircled by an opening 90 which is also the outlet from chamber 84. Opening 90 is communicated to a variable volume chamber 92 in which a reciprocally mounted piston 94 forms a movable wall. When the valve stem 86 moves upward in the drawing, the flow passage between the opening 90 and the tapered portion 88 increases. When the valve stem 86 is moved downward, the flow passage is decreased. Upward movement of the valve stem corresponds to an opening of the engine throttle or, in other words, depression of the accelerator. Thus, the pressure in chamber 92 is increased with increased engine speed and decreases when the throttle is closed and the engine speed decreases. The oil in chamber 92 flows through a passage 96 and past the flow restriction caused by the lower end of a manually actuated pressure adjuster or restricter 98. The oil then flows through a passage 100 to a second variable volume chamber 102. Chamber 102 discharges to the oil sump by an opening 104 and conduit 106.

Piston 94 separates the variable volume chambers 92, 102. When oil is flowing through the controller by operation of the oil pump, a leftward force is provided on the piston 94 and connected control rod 68 which extends from the servo valve 52 to piston 94. At more open throttles, the leftward force increases as the engine speed also increases. At a given speed, this force is reduced as the throttle closes. The spring 108 in chamber 102 resists the leftward force on piston 94 and tends to move the control rod 68 toward the right.

The control rod 68 extends through a back pressure sensor assembly 110 located between the servo valve 52 and the controller housing 78. the back pressure sensor 110 includes housing portions 112, 114 which enclose interior spaces. The space is divided by a flexible diaphragm 116 into a high pressure chamber 118 to the left of the diaphragm and a lower pressure chamber 120 to the right of the diaphragm. The diaphragm 116 is held at its periphery between the housing members 112, 114 and secured by a crimped-over portion 122. The midportion of the diaphragm 116 is reinforced and fixed to the control rod 68 by stiffening washers 124, 126. The high pressure chamber 118 is communicated with exhaust in a portion of pipe 10 upstream from throttle valve 22 by a confuit 128 and an opening 130 in housing 112. A drain opening 132, restriction 134 and conduit 136 permit the return of any oil to the oil sump that may leak into chamber 118. The low pressure chamber 120 is vented through opening 138 and by conduit 140 to atmosphere and it, too, has an oil drain to the sump through opening 142 and conduit 144.

In operation, the controller establishes a unique pressure force on piston 94 and connected rod 68 for each combination of engine load and speed as established by the oil pump drive and positioning of the valve 86. The differential pressure force produced on diaphragm 116 and rod 68 are exerted to the right in opposition to the aforementioned forces on piston 94. Thus, rod 68 attains a desired equilibrium position corresponding to the pressure balance. Spring 108 and the spring 146 in chamber 102, 120 oppose one another and provide system damping as well as aid in holding the control rod 68 in a neutral position during idling or "off" periods. The position of rod 68 established by the aformentioned influences delivers oil to the chamber 48 of the hydraulic actuator through the line 50. The pressure force in chamber 48 on piston 38 moves the piston 38 against the force of spring 44 and any small force generated in chamber 148. The opening 150 in conduit 152 is provided in association with chamber 148 to withdraw any leaked oil. It should also be noted that the spring pressure on piston 32 can be adjusted by turning bushing 42 inward and outward in housing 38 by use of its threaded connection thereto.

When the flow restrictions produced in the exhaust system by components 14, 18 increases, this increased pressure is transmitted by line 128 to chamber 118 which tends to move the diaphragm and connected rod 68 rightward. This rightward movement decreases the flow of hydraulic fluid to the chamber 48 through line 50 and thereby decreases the pressure therein. This permits spring 44 to move piston 32 toward the left. This movement of piston 32 causes the interconnected throttling valve 22 to move toward a more open position, thereby compensating for the increased flow restriction downstream caused by the other components of the exhaust system. However, if the engine is idling or at a low speed or light load operating conditions, the decrease in oil pressure from the pump and decreased by valve 86 permits spring 108 to move piston 94 to the right. This has the effect of decreasing the pressure in chamber 48 and causes the throttling valve 22 to assume a more open position conducive to more power output from the engine.

Although the embodiment illustrated is a preferred embodiment, other modifications of the illustrated embodiment are possible without deviating from the invention which is defined in the following claims.

What is claimed is as follows:

1. In a motor vehicle having a fuel burning engine with an exhaust system, including components having variable flow resistance, an exhaust pressure control to automatically maintain a scheduled back pressure on the engine over a normal operating speed and load range despite changes in the flow resistance of the other exhaust components, comprising: a pivotal throttling valve located downstream from the engine and upstream from the variable resistance exhaust components; positioning means connected to said throttling valve for pivotal control of said throttling valve between open and a more closed operative position; an exhaust back pressure sensor including enclosure means with a flexible diaphragm responsive to the exhaust system pressure upstream from said throttling valve to produce a force on said diaphragm in one direction; an engine driven fluid pump for pressurizing fluid corresponding to operation of the engine; a controller assembly including a housing defining an interior space with an inlet thereto fluidly connected to said engine-driven pump for receiving pressurized fluid therefrom; said controller housing enclosing a piston member movable in response to fluid pressure within said interior space to produce a force on the piston member in a direction opposite to said one direction of said diaphragm force; a fluid valve means including a reciprocal valving member connected to said diaphragm and said piston member for regulating the transmission of fluid pressure from said engine-driven pump to said positioning means, thereby transmitting pressurized fluid to said throttling valve positioning means corresponding to the effects of exhaust system back pressure and engine speed on the sensor and controller assembly; means responsive to closing off the engine throttle control for causing said exhaust throttling valve to move to a more open position to increase engine power at low speed and light load operating conditions.

2. In a motor vehicle having a fuel-burning engine with an exhaust system, including components having variable resistance flow, an exhaust pressure control to automatically maintain a scheduled back pressure on the engine over a normal operating speed and load range despite changes in the flow resistance of the other exhaust components, comprising: a pivotal throttling valve located downstream from the engine and upstream from the variable resistance exhaust components; positioning means connected to said throttling valve for pivotal control of said throttling valve between open and a more closed operative position; an exhaust back pressure sensor including enclosure means with a flexible diaphragm for producing a force in one direction on the diaphragm corresponding to the exhaust pressure upstream from said throttling valve; a fluid pump operably connected to said engine for fluid pressurization corresponding to the operation of the engine; controller means including an enclosure with an inlet connected to said fluid pump and a reciprocable member supported therein movable in a direction opposite to said one direction of said diaphragm force and in response to the pressure level of said enclosure; metering means associated with said enclosure inlet for controlling the pressure transmitted to said enclsoure and being responsive to the engine throttle position so that low throttle positioning produces decreased pressure levels in said enclosure; a fluid valve with a movable valving member therein connected to said diaphragm member and said reciprocable controller member and positioned in response to the pressure balance on said member to transmit a pressure to said throttle valve positioning means to maintain a substantially scheduled back pressure over the normal engine speed and load range, whereby said metering means decreases the pressure in said control enclosure when the engine throttle is in a low speed and light load position so as to cause said exhaust throttling valve to move toward a more open position during this low speed and light load operating range.

3. In a motor vehicle having a fuel-burning engine witn an exhaust system, including components with variable flow resistance, an exhaust pressure control to automatically maintain a scheduled back pressure on the engine over a normal operating speed and load range despite changes in the flow resistance of the other exhaust components, comprising: a pivotal throttling valve located downstream from the engine and upstream from the variable resistance components; positioning means connected to said throttling valve for controlled pivotal movement of said throttling valve between open and more closed operative positions; said positioning means including a housing with a reciprocal member therein moved in response to fluid pressurization of the housing interior, said reciprocal positioning member being operably connected to said exhaust system throttling valve to pivot said throttling valve between open and more closed positions thereby changing the total flow restrictive effect of the exhaust system including said variable flow resistive components; a back pressure sensor defining an enclosure with a flexible diaphragm exposed to exhaust system pressure existing upstream from said exhaust throttling valve to produce a diaphragm force in a first direction corresponding to the back pressure on said engine; an engine-driven fluid pump for pressurizing fluid in response to operation of the engine; a controller assembly including a housing and a movable piston member therein forming enclosures on either side which are fluidly connected to said engine-driven fluid pump to exert forces on said movable piston; said pressurized fluid first entering one enclosure on one side of said piston and then flowing past a restrictor to recuce pressure into the other enclosure on a second side of said piston, whereby the net force on the piston member is in a direction opposite to the direction of said diaphragm force and proportional to the pressure level at the inlet of said enclosures; means including a tapered metering member at the inlet of said enclosure which is operably connected to the engine fuel control mechanism for regulating fluid pressure within said enclosures so that a low setting of said engine fuel control decreases the pressurization of said first and second enclosures; valve means including a reciprocal valving member connected to said diaphragm and said reciprocal piston member of said controller to regulate fluid pressure transmitted to said exhaust throttling valve positioner in response to the force balance of forces on said diaphragm and said movable piston member, thereby establishing a position of said exhaust throttling valve to produce a substantially scheduled exhaust back pressure on said engine in combination with the other variable restriction exhaust components.

* * * * *